US010274170B2

(12) United States Patent
Patil et al.

(10) Patent No.: US 10,274,170 B2
(45) Date of Patent: Apr. 30, 2019

(54) DRAIN SYSTEM FOR A LUMINAIRE

(71) Applicant: Appleton Grp LLC, Rosemont, IL (US)

(72) Inventors: Santosh K. Patil, Pune (IN); Vinaya N. Kubsad, Pune (IN); Harish P. Kulkarni, Pune (IN); Harsha N. Devappa, Pune (IN); William Leber, Vernon Hills, IL (US); Timothy E. Graff, Arlington Heights, IL (US)

(73) Assignee: Appleton Grp LLC, Rosemont, IL (US)

( * ) Notice: Subject to any disclaimer, the term of this patent is extended or adjusted under 35 U.S.C. 154(b) by 1 day.

(21) Appl. No.: 15/705,971

(22) Filed: Sep. 15, 2017

(65) Prior Publication Data

US 2019/0017682 A1 Jan. 17, 2019

(30) Foreign Application Priority Data

Jul. 13, 2017 (IN) ..... 201721024874

(51) Int. Cl.

| | |
|---|---|
| ***F21V 23/00*** | (2015.01) |
| ***F21V 31/00*** | (2006.01) |
| ***F21V 15/01*** | (2006.01) |
| ***F21V 21/008*** | (2006.01) |

(52) U.S. Cl.

CPC ..... *F21V 15/01* (2013.01); *F21V 21/008* (2013.01); *F21V 23/001* (2013.01); *F21V 31/00* (2013.01)

(58) Field of Classification Search

CPC ..... F21V 15/015

USPC ..... 362/368, 362

See application file for complete search history.

(56) References Cited

U.S. PATENT DOCUMENTS

| | | | |
|---|---|---|---|
| 5,243,132 | A | 9/1993 | Yarbrough |
| 7,125,146 | B2 | 10/2006 | Willis et al. |
| 7,367,688 | B1 | 5/2008 | Bucher et al. |
| 2006/0114668 | A1 | 6/2006 | Hagen |

(Continued)

OTHER PUBLICATIONS

The International Search Report of the International Searching Authority issued in PCT/US2017/062988 dated Apr. 13, 2018, 3 pages.

(Continued)

*Primary Examiner* — Edwyn Labaze
(74) *Attorney, Agent, or Firm* — McDonnell Boehnen Hulbert & Berghoff LLP

(57) ABSTRACT

The present disclosure relates to the field of luminaires. More specifically, the present disclosure envisages a drain arrangement for use with a luminaire that is supported on a wiring conduit via a junction box. The arrangement includes a hood coupled with the junction box via a connecting conduit, wherein connection cables from the wiring conduit are received within the hood via the connecting conduit and the junction box. An adaptor extends from the hood and the luminaire. The adaptor is defined by a sidewall extending from the luminaire and has an operative top surface configured on an operative top periphery of the sidewall. The adaptor further includes an annular inner sidewall configured to circumscribe an electric connection of the luminaire. A drain conduit extends from the adaptor and is configured to drain out the fluid collected within the adaptor outside of the annular inner sidewall.

10 Claims, 12 Drawing Sheets

(56) References Cited

U.S. PATENT DOCUMENTS

| | | | | |
|---|---|---|---|---|
| 2007/0278504 | A1* | 12/2007 | Jasmin | G11B 7/26 257/89 |
| 2012/0020060 | A1* | 1/2012 | Myer | F21S 2/00 362/183 |
| 2015/0144372 | A1* | 5/2015 | Grant | F21V 21/22 174/68.3 |
| 2016/0215967 | A1* | 7/2016 | Chad | F21V 23/06 |

OTHER PUBLICATIONS

The Written Opinion of the International Searching Authority issued in PCT/US2017/062988 dated Apr. 13, 2018, 8 pages.
Pre-2017 prior art luminaire component, 1 page.

* cited by examiner

DRAIN SYSTEM FOR A LUMINAIRE

PRIORITY CLAIM

This application claims priority to Indian Patent Application No. IN201721024874 filed on Jul. 13, 2017 entitled "A Drain Arrangement For a Luminaire," the contents of which is incorporated by reference herein in its entirety.

FIELD

The present disclosure relates to the field of luminaires.

BACKGROUND

LED luminaires or LED lightings have found wide application in the different industries due to their improved performance as compared to the different types of conventional luminaires. A typical industrial setup, such as an oil refinery, can include at least 100 such luminaires arranged near the ceiling of the industrial setup. FIG. 1 illustrates a schematic view of a conventional luminaire 10. The mounting of the luminaires is facilitated by wiring conduits 12 configured near the ceiling, to which the luminaires 10 are connected via connecting conduits 14. A problem associated with such conventional setups is that water may enter the wiring conduit 12 due to various reasons, which may include condensation or leakage of rain water. This leakage of water into the wiring conduits 12 causes the water to seep through the connecting conduit 14 and into the luminaire 10. This is not desired as it can cause failure of the luminaire 10. Also, water entering the luminaire 10 is a safety hazard, which needs to be avoided.

Hence, in order to overcome the aforementioned drawbacks, the present disclosure envisages a luminaire with an arrangement to drain out water from the luminaire before the water approaches any electric connection of the luminaire.

Objects

Some of the objects of the present disclosure, which at least one embodiment herein satisfies, are as follows:

An object of the present disclosure is to provide a drain arrangement for use with a luminaire, which prevents failure of the luminaire caused due to leakage of water inside the luminaire.

Another object of the present disclosure is to provide a drain arrangement for use with a luminaire, which drains the leaked water even before the leaked water approaches the electric connection of the luminaire.

Other objects and advantages of the present disclosure will be more apparent from the following description, which is not intended to limit the scope of the present disclosure.

SUMMARY

The present disclosure envisages a drain arrangement for use with a luminaire that is supported by a wiring conduit via a junction box. The drain arrangement comprises a hood coupled with the junction box via a connecting conduit, wherein connection cables from the wiring conduit are received within the hood via the connecting conduit and the junction box. An adaptor is connectable to the hood and the luminaire. The adaptor is defined by a sidewall extending from the luminaire and has an operative top surface configured on an operative top periphery of the sidewall. The adaptor also has an annular inner sidewall configured to circumscribe an electric connection of the luminaire. A drain conduit extends from the adaptor and is configured to drain out fluid collected within the adaptor outside of the annular inner sidewall.

In an embodiment, at least one aperture is configured on the operative top surface for allowing the connection cables to enter inside the adaptor for connecting with the electric connection. An ingress prevention means is fitted on the at least one aperture to prevent the ingress of a fluid within the annular inner sidewall.

In an embodiment, the arrangement includes at least one connecting structure extending from the operative top surface and surrounding the at least one aperture. In another embodiment, the ingress prevention means is a cap fitted on the at least one connecting structure, wherein the cap has at least one aperture for receiving the connection cables. In another embodiment, the ingress prevention means are plugs fitted onto the connecting structures, the plug has at least one aperture configured thereon to receive the connection cables.

In another embodiment, the arrangement includes a unidirectional drain plug mounted on a free end of the drain conduit to facilitate unidirectional discharge of a fluid from the drain conduit.

In accordance with another embodiment, the drain arrangement, for use with a luminaire supported on a wiring conduit via a junction box, comprises a hood coupled with the junction box via a connecting conduit, wherein connection cables from the wiring conduit are received within the hood via the connecting conduit and the junction box. An adaptor is connectable to the hood and the luminaire and is defined by a sidewall extending from the luminaire. The adaptor has an operative top surface configured on an operative top periphery of the sidewall. The adaptor is configured to house an electric connection of the luminaire. At least one aperture is configured on the operative top surface for allowing the connection cables to enter inside the adaptor for connecting with the electric connection. A resilient elbow is fitted to an aperture of the hood, wherein the aperture interfaces with the connecting conduit. The resilient elbow has at least one cable receiving aperture to sealably receive the connection cables, and at least one drain aperture configured to allow drainage of a fluid before the fluid approaches the adaptor. A drain conduit extends from the hood and is in fluid communication with the resilient elbow. The drain conduit is configured to drain out fluid from the hood.

In accordance with another embodiment, a drain arrangement, for use with a luminaire supported on a wiring conduit via a junction box, is disclosed. The drain arrangement comprises a drain conduit that extends from the junction box and is configured to drain out the fluid collected in the wiring conduit, wherein the luminaire extends in an offset manner from the drain conduit.

BRIEF DESCRIPTION OF THE ACCOMPANYING DRAWINGS

A drain arrangement for use with a luminaire, of the present disclosure will now be described with the help of the non-limiting accompanying drawings, in which.

Figure 3A:
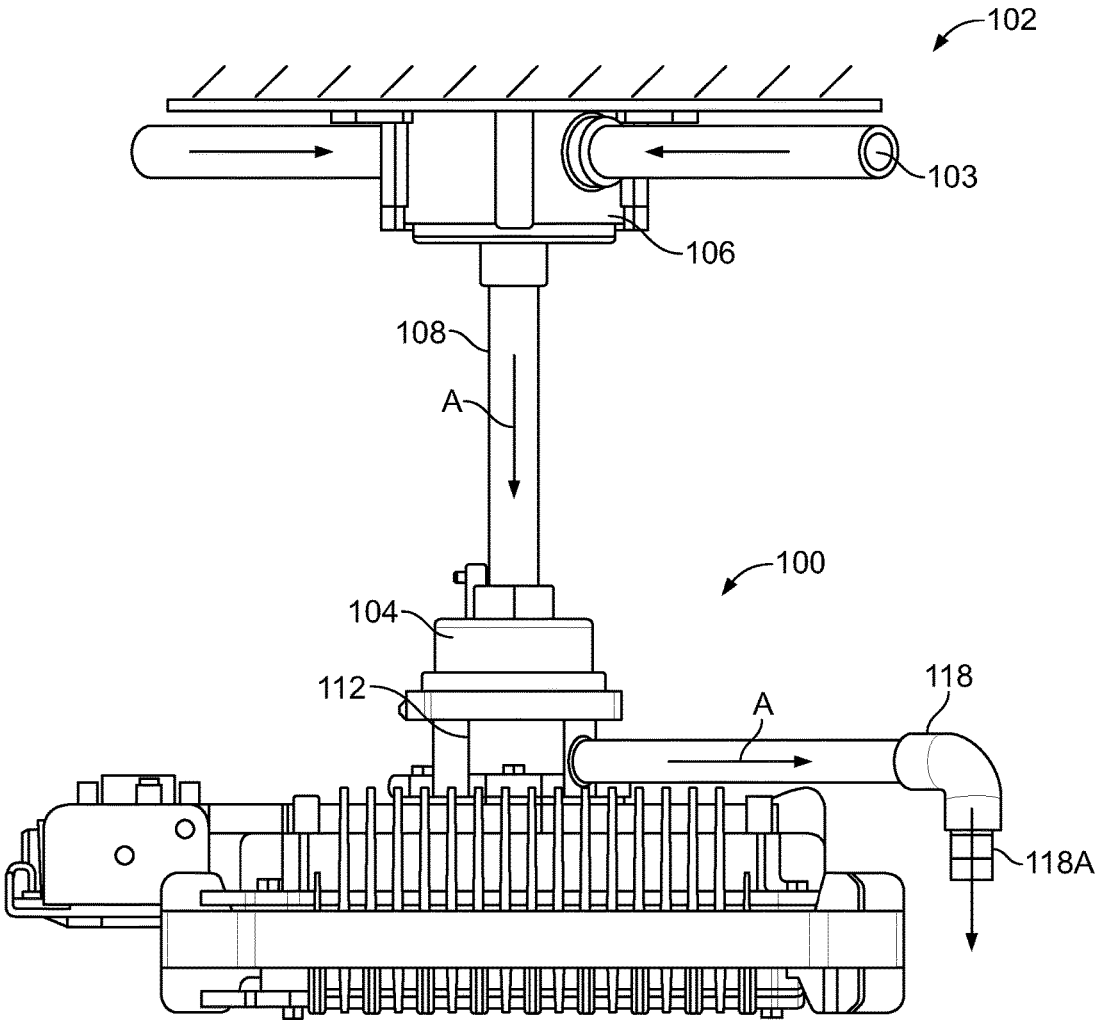
FIG. 3A and FIG. 3B illustrate different views of a luminaire with a drain arrangement, in accordance with another embodiment of the present disclosure.
Figure 3B:
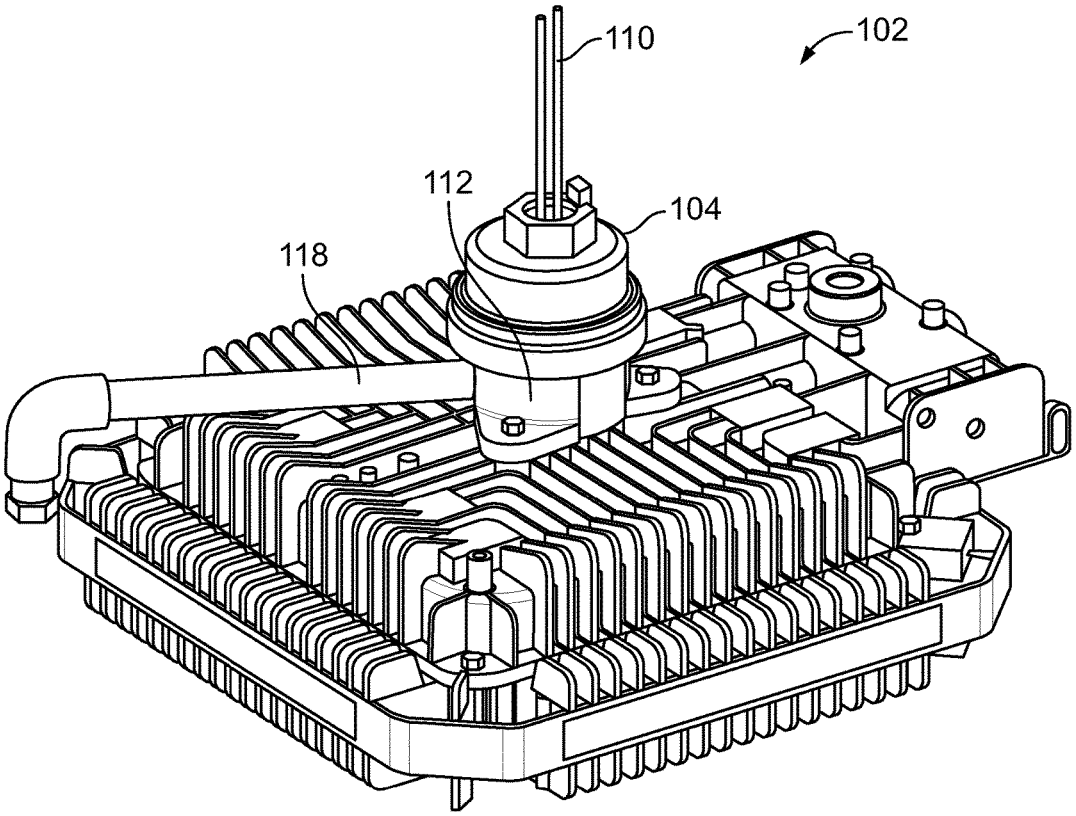
Figure 4A:
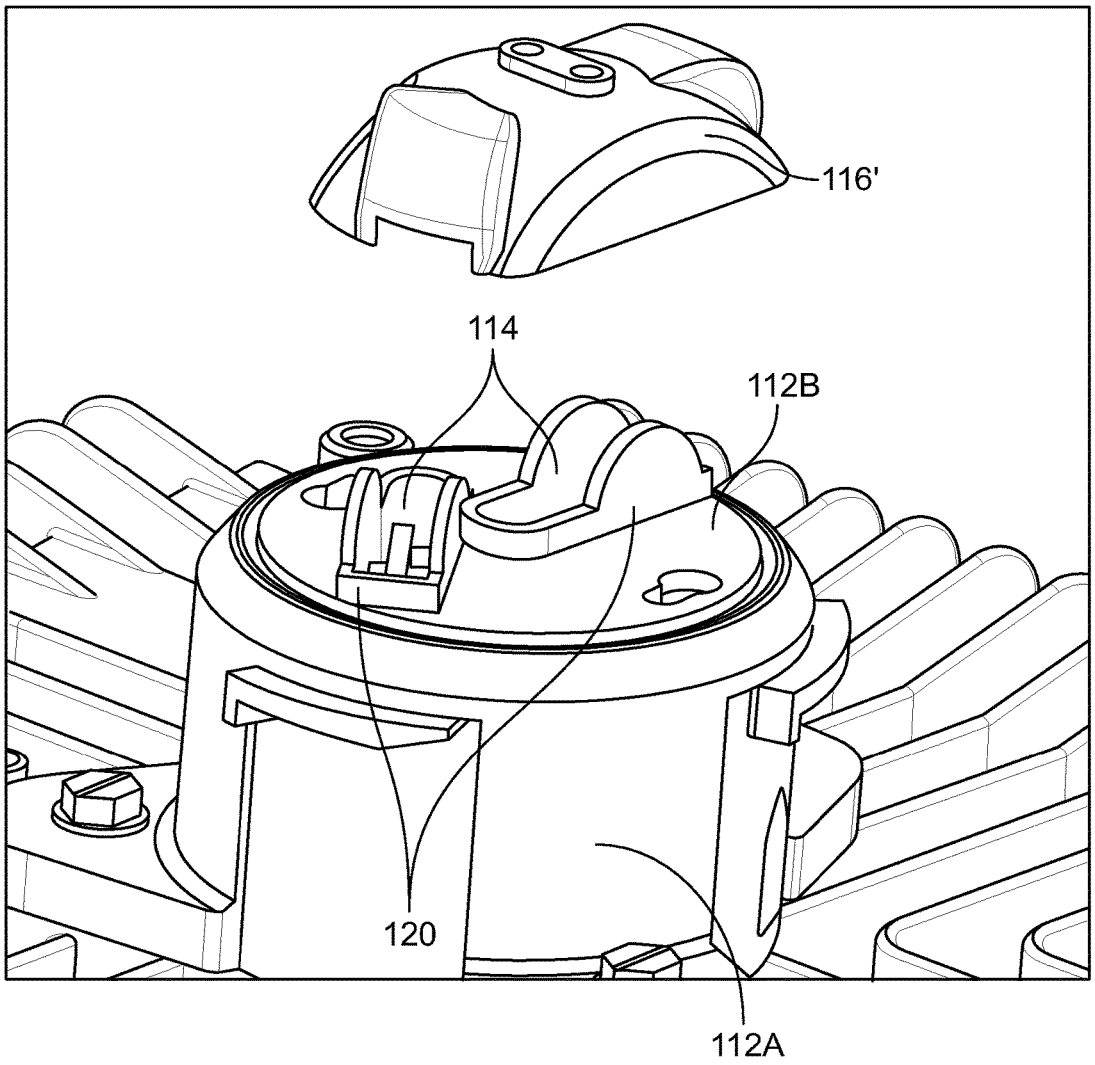
Figure 4B:
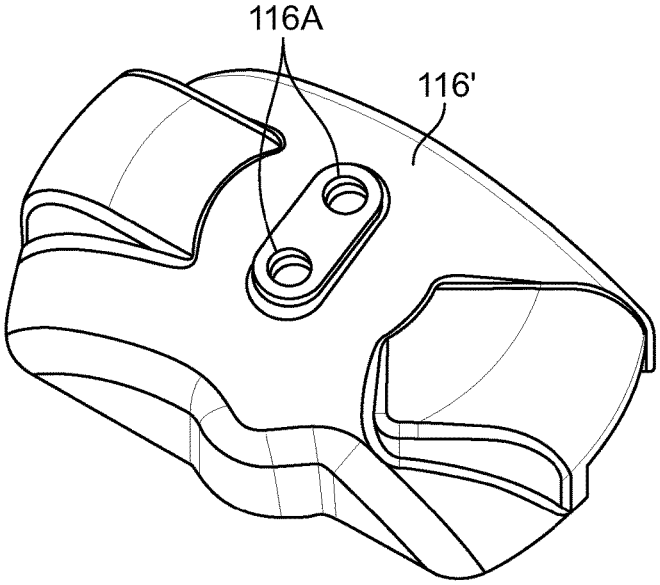
Figure 4C:
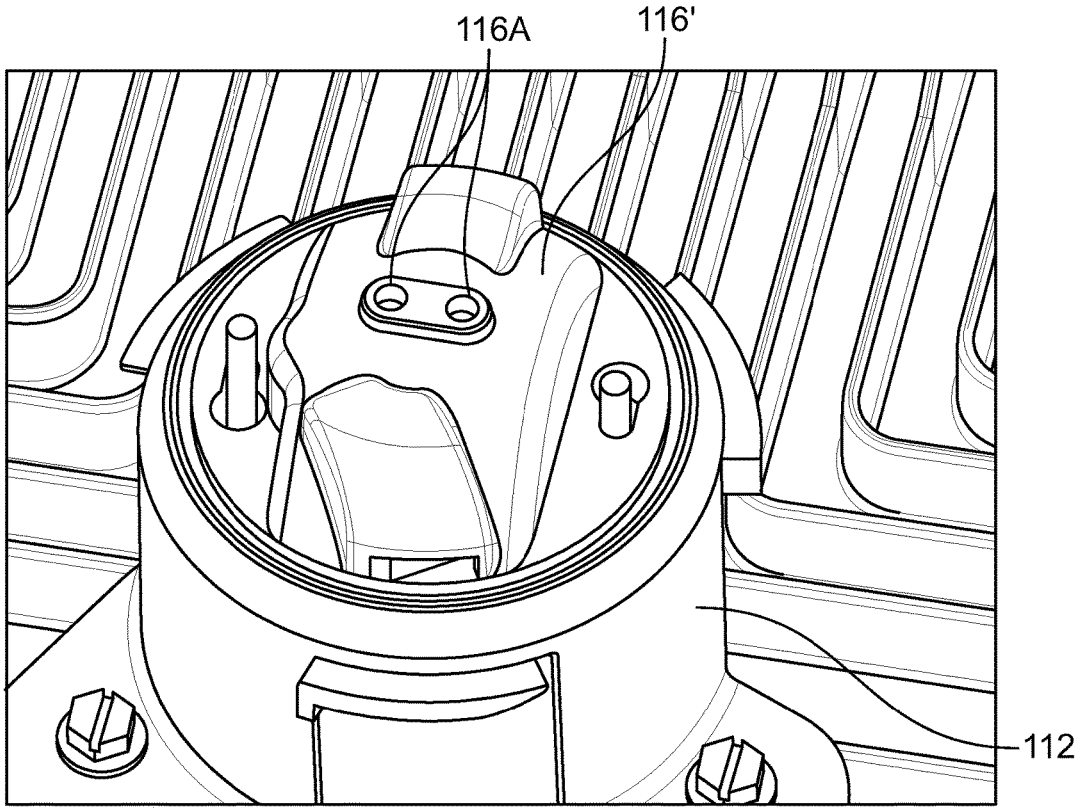
Figure 5:
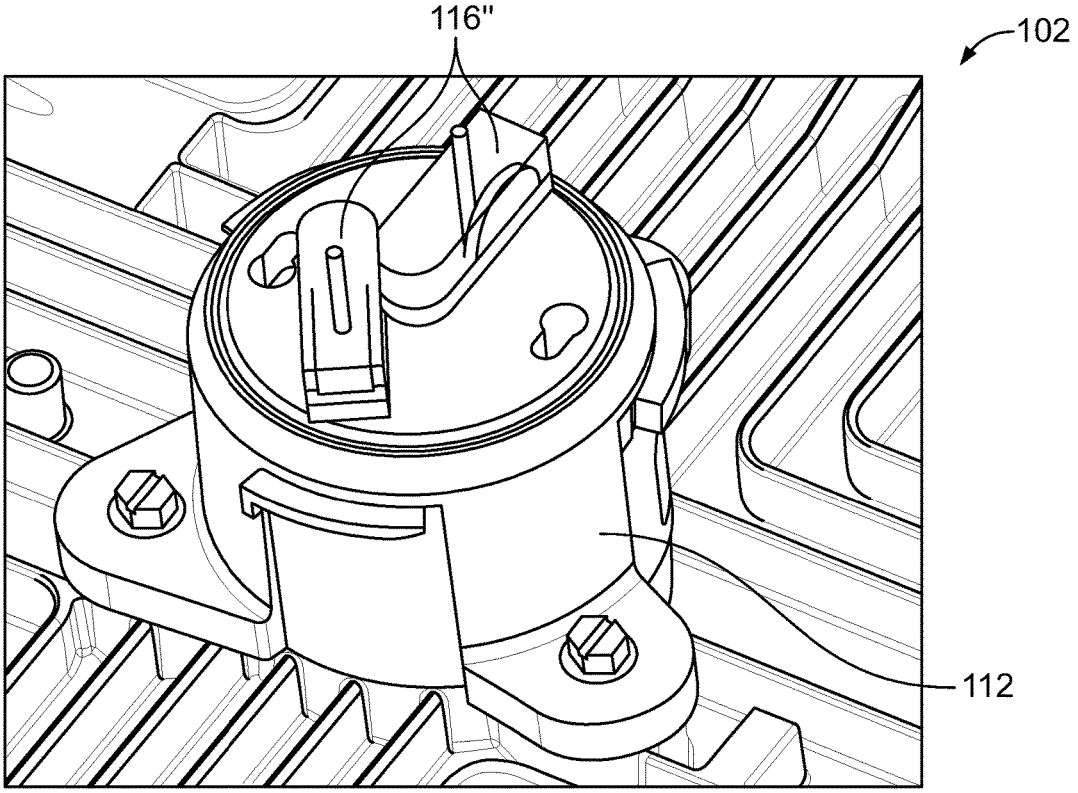
Figure 6A:
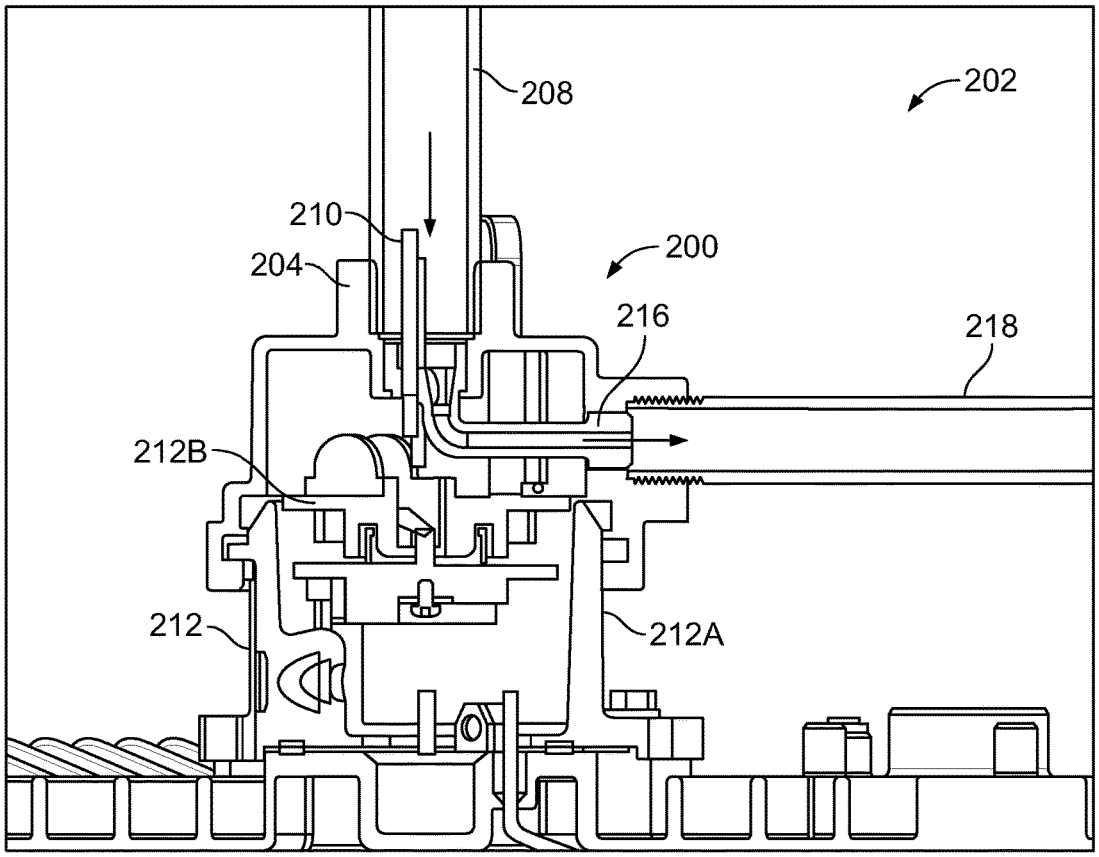
Figure 6B:
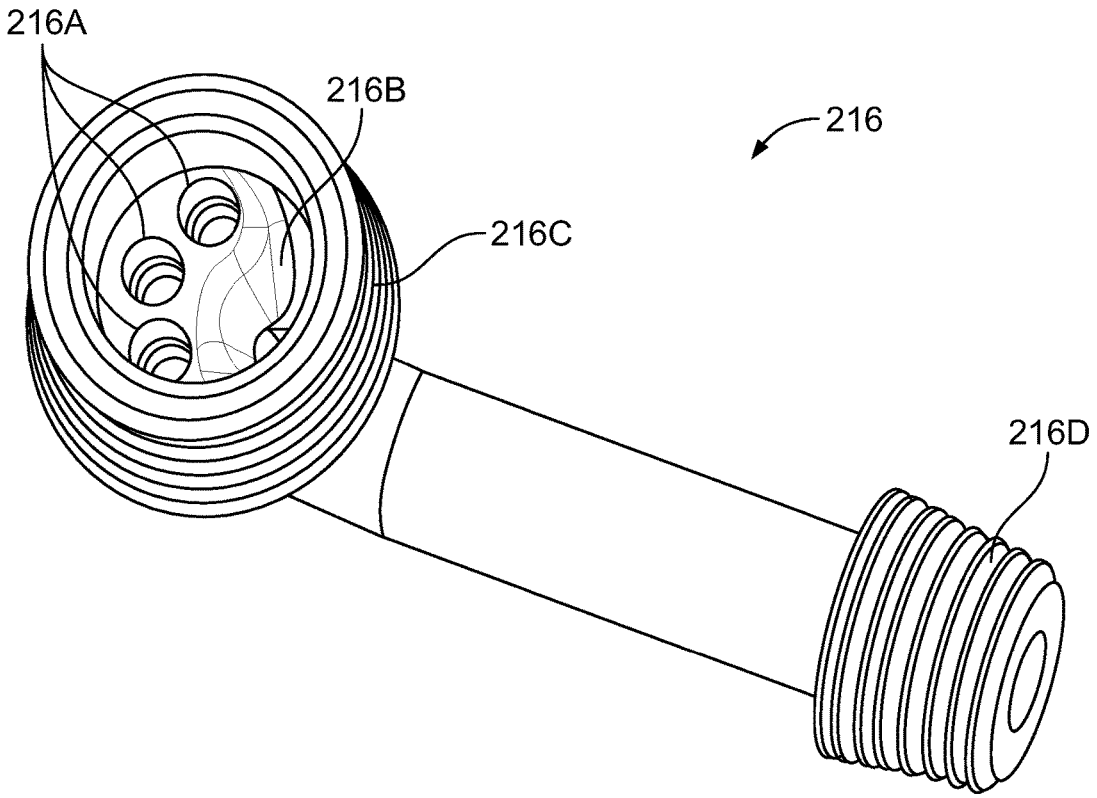
Figure 7:
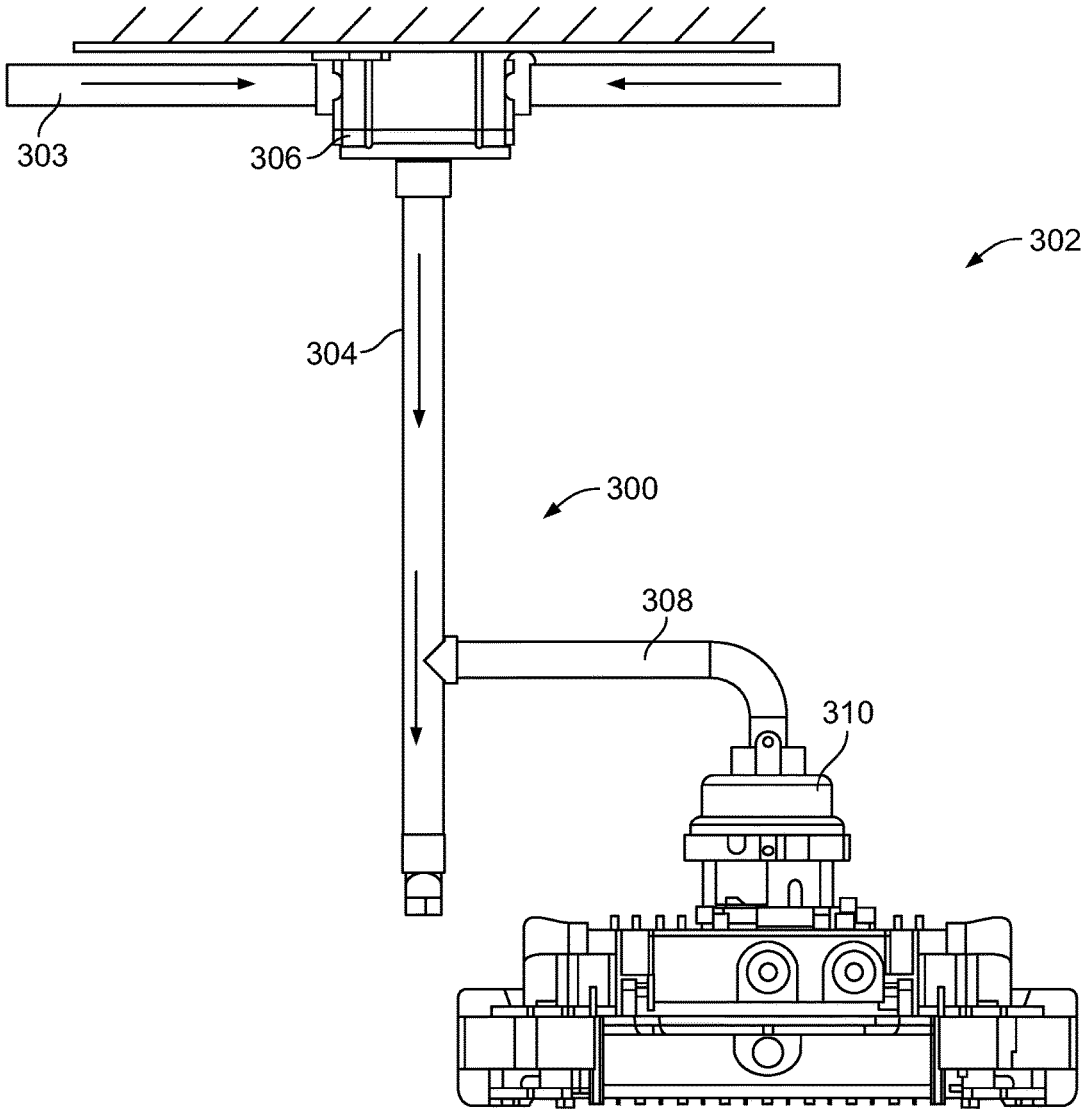

FIG. 4A, FIG. 4B, and FIG. 4C illustrate different views of a cap used in the luminaire of FIG. 3A;

FIG. 5 illustrates an isometric view of a plug being used as an ingress prevention means, in accordance with an embodiment of the present disclosure;

FIG. 6A illustrates a schematic view of a luminaire with a drain arrangement, in accordance with another embodiment of the present disclosure;

FIG. 6B illustrates an isometric view of a resilient elbow used in the luminaire of FIG. 6A; and FIG. 7 illustrates a schematic view of a luminaire with a drain arrangement, in accordance with yet another embodiment of the present disclosure.

LIST OF REFERENCE NUMERALS

10—Luminaire
12—Wiring conduit
14—Connecting conduits
50, 100, 200, 300—Drain arrangement
52, 102, 202, 302—Luminaire
53, 103, 303—Wiring conduit
54, 104, 204, 310—Hood
56, 106, 306—Junction box
58, 108, 208, 308—Connecting conduit
110, 210—Connection cables
62, 112, 212—Adaptor
62A, 112A, 212A—Sidewall
62B, 112B, 212B—Operative top surface
62C—Annular inner sidewall
114—Apertures
116', 116"—Ingress prevention means, cap, plug
116A—Aperture
68, 118, 218, 304—Drain conduit
118A—Drain plug
120—Connecting structures
216—Resilient elbow
216A—Cable receiving aperture
216B—Drain Aperture
216C, 216D—Connecting portions

DETAILED DESCRIPTION

Figure 1:
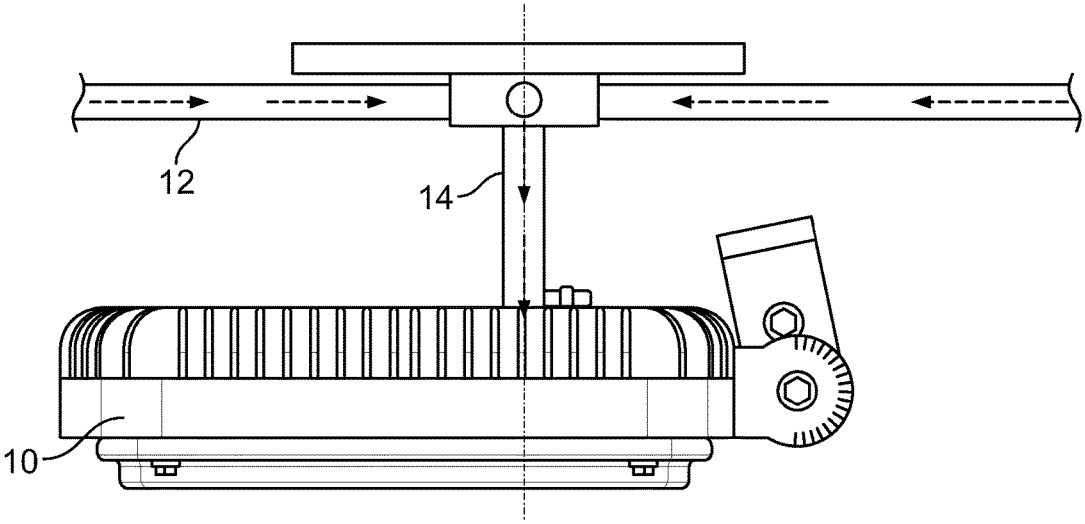
FIG. 1 (Prior Art)
FIG. 1 illustrates a schematic view of a conventional luminaire.

LED luminaires or LED lightings have found wide application in the different industries due to their improved performance as compared to the different types of conventional luminaires. A typical industrial setup, such as an oil refinery, can include at least 100 such luminaires arranged near the ceiling of the industrial setup. FIG. 1 illustrates a schematic view of a conventional luminaire 10. The mounting of the luminaires is facilitated by wiring conduits 12 that are configured near the ceiling, to which the luminaires 10 are connected via connecting conduits 14. A problem associated with such conventional setups is that water may enter the wiring conduit 12 due to various reasons, which may include condensation or leakage of rain water into the wiring conduit 12. This leakage of water into the wiring conduits 12 causes the water to seep through the connecting conduit 14 and into the luminaire 10. This is not desired as it can cause the failure of the luminaire 10. Also, water entering the luminaire 10 is a safety hazard, which needs to be avoided.

In order to overcome the aforementioned drawbacks, the present disclosure envisages a drain arrangement for use with a luminaire. The drain arrangement, as envisaged in the present disclosure, prevents the failure of the luminaire caused due to the leakage of water inside the luminaire. Furthermore, the drain arrangement, in accordance with the present disclosure, drains the leaked water even before the leaked water approaches the electric connection of the luminaire.

Figure 2A:
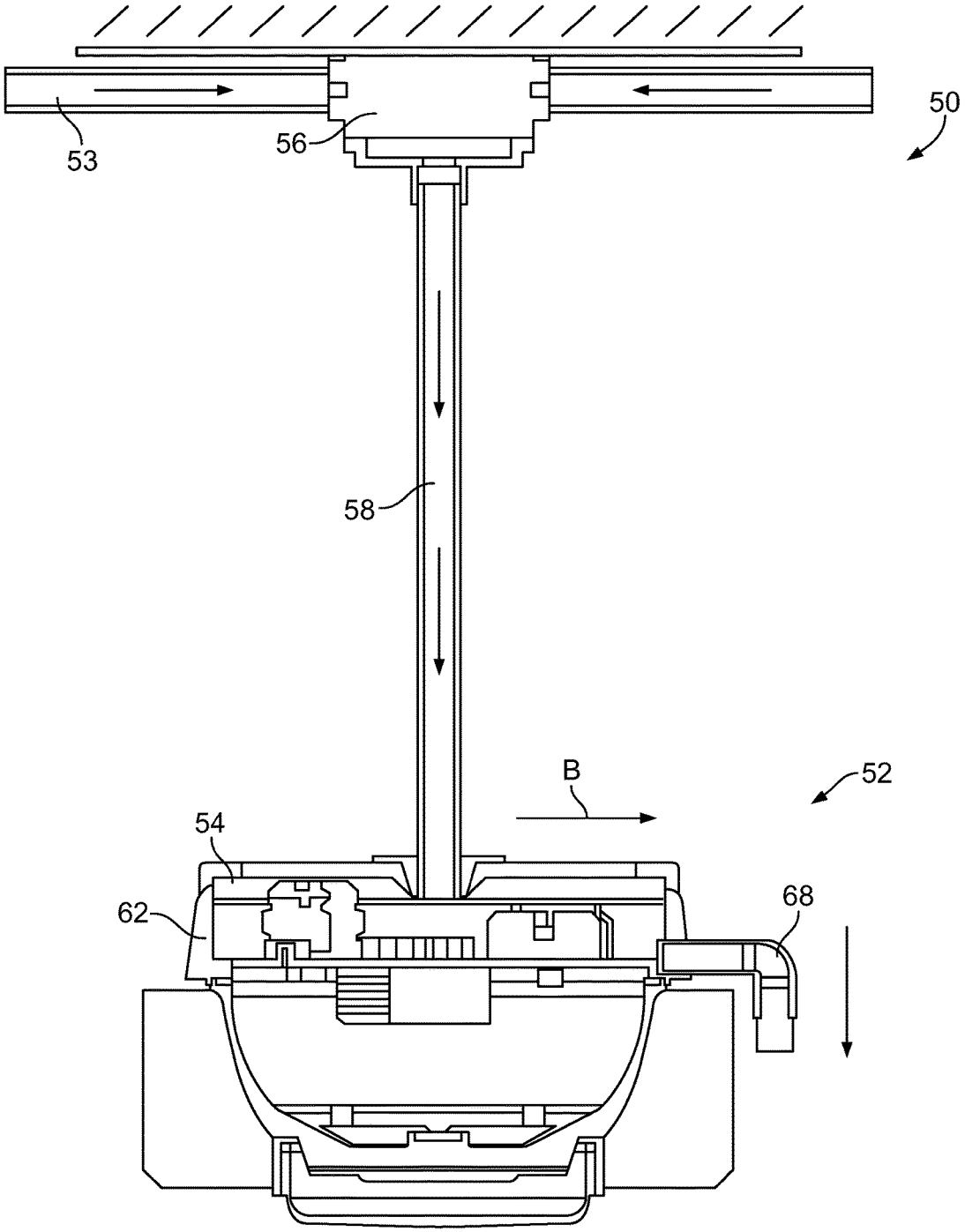
FIG. 2A through FIG. 2C illustrate different views of a luminaire with a drain arrangement, in accordance with an embodiment of the present disclosure.
Figure 2B:
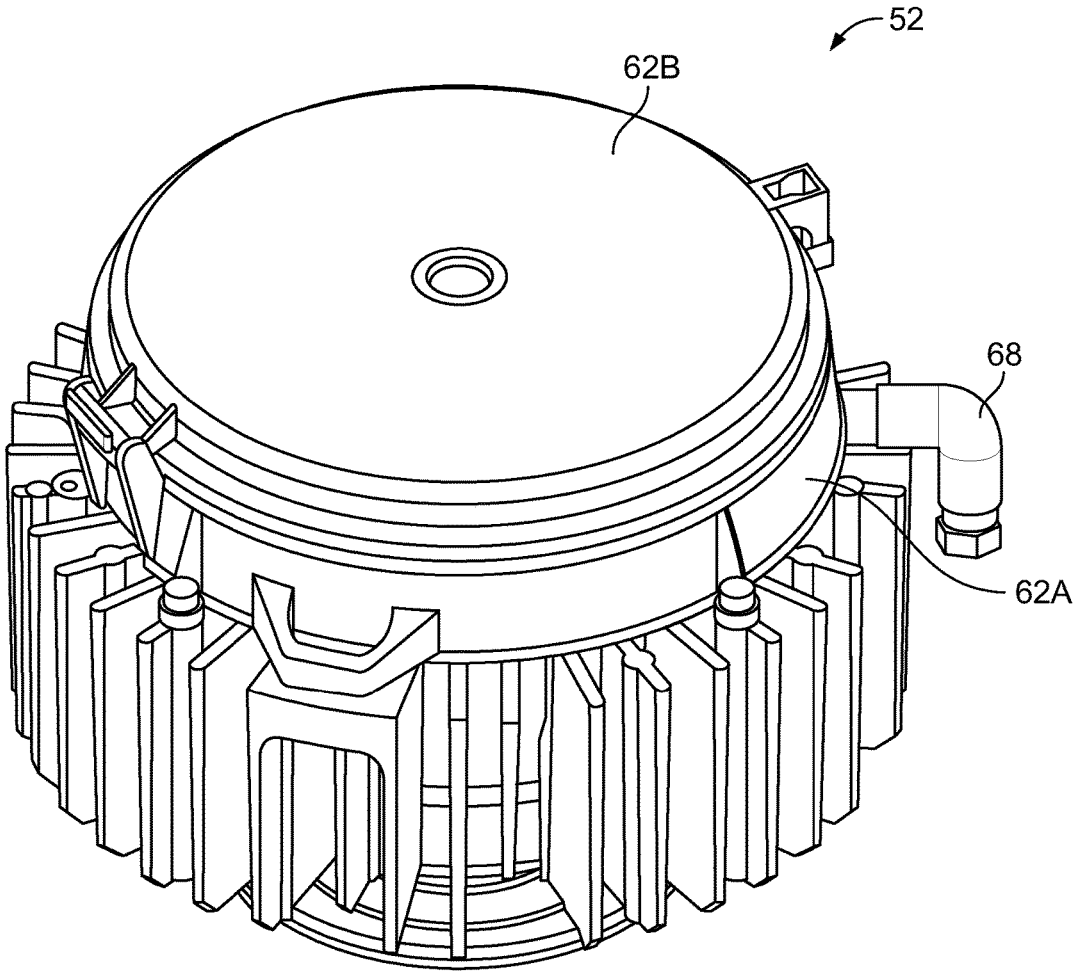
Figure 2C:
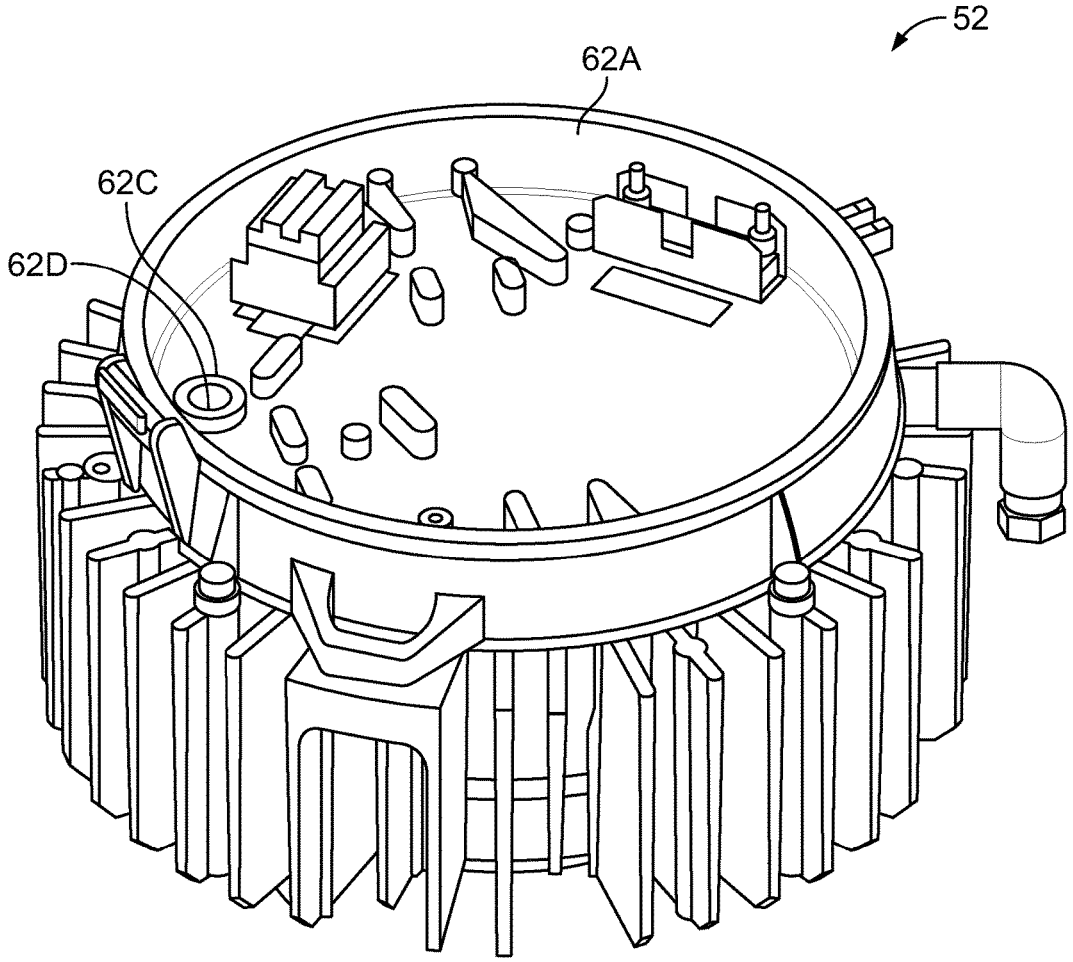

A drain arrangement 50 (hereinafter referred to as arrangement 50) for use with a luminaire 52 is now described with reference to FIG. 2A through FIG. 2C. The luminaire 52 is supported on a wiring conduit 53 which is generally mounted adjacent the ceiling. The arrangement 50 comprises a hood 54 coupled with a junction box 56 via a connecting conduit 58, wherein connection cables from the wiring conduit 53 are received within the hood 54 via the connecting conduit 58 and the junction box 56. More specifically, the junction box 56 is mounted on the wiring conduit 53 and acts as a coupler between the connecting conduit 58 and the wiring conduit 53. The connecting conduit 58, in turn acts as a coupler between the junction box 56 and the hood 54.

An adaptor 62 extends from the hood 54 and the luminaire 52. The adaptor 62 is defined by a sidewall 62A extending from the luminaire 52 and has an operative top surface 62B configured on an operative top periphery of the sidewall 62A. The adaptor 62 also has an annular inner sidewall 62C configured to circumscribe an electric connection of the luminaire 52. In an embodiment, the adaptor 62 is assembled with the luminaire by means of fasteners, while in another embodiment, the adaptor 62 is made integral with the luminaire 52.

The arrangement 50 further includes a drain conduit 68, which extends from the adaptor 62 and is configured to drain out the fluid collected within the adaptor 62 outside of the annular inner sidewall 62C. In an embodiment, the leaked fluid is water that happens to leak inside the wiring conduit 53. The water can enter the wiring conduit 53 either due to condensation or leakage of rainwater or due to any other reason. The flow of water from the wiring conduit 53 through the drain conduit 68 is indicated in FIG. 2A via arrow "B".

A drain arrangement 100 (hereinafter referred to as arrangement 100) for use with a luminaire 102 is now described with reference to FIG. 3A through FIG. 4C. The luminaire 102 is supported on a wiring conduit 103 which is generally mounted adjacent the ceiling. The arrangement 100 comprises a hood 104 coupled with a junction box 106 via a connecting conduit 108, wherein connection cables 110 from the wiring conduit 103 are received within the hood 104 via the connecting conduit 108 and the junction box 106. More specifically, the junction box 106 is mounted on the wiring conduit 103 and acts as a coupler between the connecting conduit 108 and the wiring conduit 103. The connecting conduit 108, in turn acts as a coupler between the junction box 106 and the hood 104.

An adaptor 112 is connectable to the hood 104 and the luminaire 102. The adaptor 112 is defined by a sidewall 112A extending from the luminaire 102 and has an operative top surface 112B configured on an operative top periphery of the sidewall 112A. The adaptor 112 also has an annular inner sidewall configured to circumscribe an electric connection of the luminaire 102. In an embodiment, the adaptor 112 is assembled with the luminaire by means of fasteners, while in another embodiment, the adaptor 112 is made integral with the luminaire 102. At least one aperture 114 is configured on the operative top surface 112B for allowing the connection cables 110 to enter inside the adaptor 112 for connecting with the electric connection. In another embodiment, the number of apertures 114 corresponds to the number of connection cables 110 needed to enter the adaptor 112. An ingress prevention means 116' is fitted on the at least one aperture 114 to prevent the leakage of a fluid within the annular inner sidewall. More specifically, the ingress prevention means 116' prevents the approach of leaked fluid towards the electric connection of the luminaire 102. The arrangement 100 further includes a drain conduit 118, which extends from the adaptor 112 and is configured to drain out the fluid collected within the adaptor 112 outside of the annular inner sidewall. In an embodiment, the leaked fluid is water that happens to leak inside the wiring conduit 103. The water can enter the wiring conduit 103 either due to condensation or leakage of rainwater or due to any other reason. The flow of water from the wiring conduit 103 through the drain conduit 118 is indicated in FIG. 3A via arrow "A".

The arrangement includes at least one connecting structure 120 extending from the operative top surface 112B and surrounding the at least one aperture 114. In an embodiment, the ingress prevention means is a cap 116' that is fitted onto the connecting structures 120. In accordance with one embodiment, the water entering the hood 104 via the wiring conduit 103 and the connecting conduit 108 enters the adaptor 112. The water entered into the adaptor 112 is kept separated from the electric connection of the luminaire 102 by means of the annular inner sidewall. As soon as the quantity of water reaches a pre-determined level, the water enters the drain conduit 118 which extends from the adaptor 112. In an embodiment, the arrangement 100 includes a unidirectional drain plug 118A mounted on a free end of the drain conduit 118 to facilitate unidirectional discharge of a fluid from the drain conduit 118. In another embodiment, the cap 116' has at least one aperture 116A for receiving the connection cables 110.

In accordance with another embodiment, as illustrated in FIG. 5, plugs 116" are used as an ingress prevention means instead of the cap 116'. The plugs 116" have at least one aperture configured thereon to receive the connection cables 110. In accordance with the present disclosure, the plugs 116" can be at least one selected from a group consisting of foam material, plastic material, rubber material, and the like.

A drain arrangement 200 (hereinafter referred to as arrangement 200) for use with a luminaire 202, in accordance with another embodiment of the present disclosure, is hereinafter described with reference to FIG. 6A and FIG. 6B. The luminaire 202 is supported on a wiring conduit via a junction box. The arrangement 200 comprises a hood 204 coupled with the junction box via a connecting conduit 208, wherein connection cables 210 from the wiring conduit are received within the hood 204 via the connecting conduit 208 and the junction box. More specifically, the junction box is mounted on the wiring conduit and acts as a coupler between the connecting conduit 208 and the wiring conduit. The connecting conduit 208, in turn acts as a coupler between the junction box and the hood 204.

An adaptor 212 is connectable to the hood 204 and the luminaire 202 and is defined by a sidewall 212A extending from the luminaire 202. The adaptor 212 has an operative top surface 212B configured on an operative top periphery of the sidewall 212A. The adaptor 212 is configured to house an electric connection of the luminaire 202. At least one aperture is configured on the operative top surface 212B for allowing the connection cables 210 to enter inside the adaptor 212 for connecting with the electric connection to, for example, an LED array.

In accordance with the present embodiment, the ingress prevention means is a resilient elbow 216 fitted to an aperture of the hood 204 that interfaces with the connecting conduit 208. The resilient elbow 216 has at least one cable receiving aperture 216A to sealably receive the connection cables 210, and at least one drain aperture 216B configured to allow drainage of a fluid before the fluid approaches the adaptor 212. A drain conduit 218 extends from the hood 204 and is in fluid communication with the resilient elbow 216. The drain conduit 218 is configured to drain out fluid from the hood 204. In other embodiments, a non-resilient elbow may be used.

The resilient elbow 216, as seen in FIG. 6B, further includes connecting portions 216C, 216D. In accordance with an embodiment, the connecting portion 216C has thread formations which are configured to be fitted on the aperture of the hood 204 that interfaces with the connecting conduit 208. The connection portion 216D is fitted with the aperture of the hood 204 that interfaces with the drain conduit 218. The water that reaches the hood 214 is routed by the resilient elbow towards the drain conduit 218 even before the water finds its way to the adaptor 212. In accordance with another embodiment of the present disclosure, the connecting portions 216C, 216D are provided with at least one of thread formations, connecting lips, serrations, and the like for facilitating the corresponding connections.

FIG. 7 illustrates a schematic view of a luminaire 302 with a drain arrangement 300, in accordance with yet another embodiment of the present disclosure. In accordance with the present embodiment, a drain conduit 304 extends from a junction box 306.

The luminaire 302 is connected with the drain conduit 304 in an off-set manner by means of a connecting conduit 308. In the present embodiment, an ingress prevention means is not required, and any water that leaks from a wiring conduit 303 is drained by the drain conduit 304 without even making contact with a hood 310.

In accordance with yet another embodiment of the present disclosure, the drain conduits 118, 218, 304 can all be fluidly coupled to a reticulated pipeline such that the water drained from the drain conduits 118, 218, 304 is discharged from only one point, instead of being discharged from each conduit on the floor of the industrial setup.

In accordance with yet another embodiment of the present disclosure, soak plugs made of super absorbent polymer materials are disposed at different locations in the wiring conduit network. In another embodiment, the soak plugs are disposed at the outlet apertures of the drain arrangement which otherwise connect with the drain conduits. These soak plugs are hygroscopic and can be used to absorb any leaking water. The water-filled soak plugs can be replaced at the time of maintenance.

TECHNICAL ADVANCEMENTS

The present disclosure described herein above has several technical advantages including, but not limited to, the realization of a drain arrangement for use with a luminaire which:

- prevents failure of the luminaire caused due to leakage of water inside the luminaire; and
- drains the leaked water even before the leaked water approaches the electric connection of the luminaire.

The foregoing disclosure has been described with reference to the accompanying embodiments which do not limit the scope and ambit of the disclosure. The description provided is purely by way of example and illustration.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Any discussion of documents, acts, materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

We claim:

1. A drain arrangement (50, 100) for use with a luminaire (52, 102) supported by a wiring conduit (53, 103) via a junction box (56, 106), said drain arrangement (50, 100) comprising:

a hood (54, 104) coupled with said junction box (56, 106) via a connecting conduit (58, 108), wherein connection cables (110) from said wiring conduit (53, 103) are received within said hood (54, 104) via said connecting conduit (58, 108) and said junction box (56, 106);

an adaptor (62, 112) extending from said hood (54, 104) and said luminaire (52, 102), said adaptor (62, 112) defined by a sidewall (62A, 112A) extending from said luminaire (52, 102), said adaptor (62, 112) having an operative top surface (62B, 112B) configured on an operative top periphery of said sidewall (62A, 112A), said adaptor (62, 112) having an annular inner sidewall configured to circumscribe an electric connection of said luminaire (52, 102); and a drain conduit (68, 118) having a free end extending from said adaptor to a point beyond an outer periphery of the luminaire and configured to drain out fluid collected within said adaptor outside of said annular inner sidewall.

2. The arrangement (100) as claimed in claim 1, wherein at least one aperture (114) is configured on said operative top surface (62B, 112B), said at least one aperture (62D, 114) allowing the connection cables (110) to enter inside said adaptor (62, 112) for connecting with said electric connection.

3. The arrangement (100) as claimed in claim 2, which includes an ingress prevention means fitted on said at least one aperture (62D, 114) to prevent the leakage of fluid within said annular inner sidewall.

4. The arrangement (100) as claimed in claim 1, which includes a unidirectional drain plug (118A) mounted on a free end of said drain conduit (118) to facilitate unidirectional discharge of a fluid from said drain conduit (118).

5. A drain arrangement (50, 100) for use with a luminaire (52, 102) supported by a wiring conduit (53, 103) via a junction box (56, 106), said drain arrangement (50, 100) comprising:

a hood (54, 104) coupled with said junction box (56, 106) via a connecting conduit (58, 108), wherein connection cables (110) from said wiring conduit (53, 103) are received within said hood (54, 104) via said connecting conduit (58, 108) and said junction box (56, 106);

an adaptor (62, 112) extending from said hood (54, 104) and said luminaire (52, 102), said adaptor (62, 112) defined by a sidewall (62A, 112A) extending from said luminaire (52, 102), said adaptor (62, 112) having an operative top surface (62B, 112B) configured on an operative top periphery of said sidewall (62A, 112A), said adaptor (62, 112) having an annular inner sidewall configured to circumscribe an electric connection of said luminaire (52, 102);

a drain conduit (68, 118) extending from said adaptor and configured to drain out fluid collected within said adaptor outside of said annular inner sidewall;

wherein at least one aperture (114) is configured on said operative top surface (62B, 112B), said at least one aperture (62D, 114) allowing the connection cables (110) to enter inside said adaptor (62, 112) for connecting with said electric connection; further including an ingress prevention means fitted on said at least one aperture (62D, 114) to prevent the leakage of fluid within said annular inner sidewall; and at least one connecting structure (120) extending from said operative top surface (112B) and surrounding said at least one aperture (114).

6. The arrangement (100) as claimed in claim 5, wherein said ingress prevention means is a cap (116') fitted on said at least one connecting structure (120), wherein said cap (116') has at least one aperture (116A) for receiving said connection cables (110).

7. The arrangement (100) as claimed in claim 5, wherein said ingress prevention means are plugs (116") fitted onto said connecting structures (120), said plugs (116") have at least one aperture configured thereon to receive said connection cables.

8. The arrangement (200) as claimed in claim 7, which includes a unidirectional drain plug mounted on a free end of said drain conduit (218) to facilitate unidirectional discharge of a fluid from said drain conduit (218).

9. A drain arrangement (200) for use with a luminaire (202) supported on a wiring conduit via a junction box, said drain arrangement (200) comprising:

a hood (204) coupled with said junction box via a connecting conduit (208), wherein connection cables (210) from said wiring conduit are received within said hood (204) via said connecting conduit (208) and said junction box;

an adaptor (212) connectable to said hood (204) and said luminaire (202), said adaptor (212) defined by a sidewall extending from said luminaire, said adaptor (212) having an operative top surface configured on an operative top periphery of said sidewall, said adaptor (212) housing an electric connection of said luminaire (202);

at least one aperture configured on said operative top surface, said at least one aperture allowing the connection cables (210) to enter inside said adaptor (212) for connecting with said electric connection;

a resilient elbow (216) fitted to an aperture of said hood (204), wherein said aperture interfaces with said connecting conduit (208), said resilient elbow (216) having at least cable receiving aperture (216A) to sealably receive said connection cables (210), and at least one drain aperture (216B) configured to allow drainage of a fluid before said fluid approaches said adaptor (212); and a drain conduit (218) extending from said hood (204) and in fluid communication with said resilient elbow (216), said drain conduit (218) configured to drain out fluid from said hood (204).

10. A drain arrangement (300), for use with a luminaire (302), supported on a wiring conduit (303) via a junction box (306), said drain arrangement (300) comprising a drain conduit (304) having a free end extending from said junction box (306) and configured to drain out fluid collected in said wiring conduit (303), wherein said luminaire (302) extends in an offset manner from said drain conduit (304), such that drain conduit (304) has a central axis that extends beyond an outer periphery of said luminaire (302).

* * * * *